United States Patent [19]

Yin-Lung

[11] Patent Number: 4,986,692

[45] Date of Patent: Jan. 22, 1991

[54] ROAD INTERSECTION CONSTRUCTION FOR TRAFFIC CONTROL

[76] Inventor: Yang Yin-Lung, P.O. Box 865, Kaohsiung, Taiwan, 80099

[21] Appl. No.: 463,860

[22] Filed: Jan. 10, 1990

Related U.S. Application Data

[63] Continuation of Ser. No. 164,811, Mar. 7, 1988, abandoned.

[30] Foreign Application Priority Data

Mar. 13, 1987 [GB] United Kingdom ..... 8706079

[51] Int. Cl.[5] ..... E01C 7/00

[52] U.S. Cl. ..... 404/1; 404/71

[58] Field of Search ..... 404/1; 14/1; 104/123, 104/124

[56] References Cited

U.S. PATENT DOCUMENTS 1,981,361 11/1934 Jones ..... 404/1

3,238,854 3/1966 Okubo ..... 404/1

FOREIGN PATENT DOCUMENTS 1429220 1/1966 France ..... 404/1

548907 4/1932 United Kingdom ..... 404/1

*Primary Examiner*—Ramon S. Britts

*Assistant Examiner*—Gay Ann Spain

*Attorney, Agent, or Firm*—Lowe, Price, LeBlanc, Becker & Shur

[57] ABSTRACT

An intersection of a main road and a branch road is described. A safety island is provided longitudinally parallel to the main road at the center line of the intersection. The safety island prevents cars from the branch road to cross the intersection. Circular detour roads beneath or above the main road are provided for traffic circulation. Underground passages for motorcycles and pedestrians may be provided beneath the intersection to eliminate interference with car traffic. Cars on the inner lane of the main roadway then can proceed through the intersection without interruption.

4 Claims, 4 Drawing Sheets

ROAD INTERSECTION CONSTRUCTION FOR TRAFFIC CONTROL

This application is a continuation of Application Serial No. 07/164,811, filed Mar. 7, 1988 now abandoned.

BACKGROUND OF THE INVENTION

The conventional methods of traffic control and road construction cause many traffic interruption problems causing car accidents or car blockage at intersections.

SUMMARY OF THE INVENTION

It is an object of this invention to provide no interruption at the intersection of two roads and let all cars go freely on their way.

Another object of the invention is to eliminate traffic signal lights at an intersection during normal conditions.

Another object of the invention is to provide at least one fast road through a city.

These and other objects will become apparent with reference to the drawings and following description wherein:

DESCRIPTION OF THE PREFERRED EMBODIMENT

Figure 1:
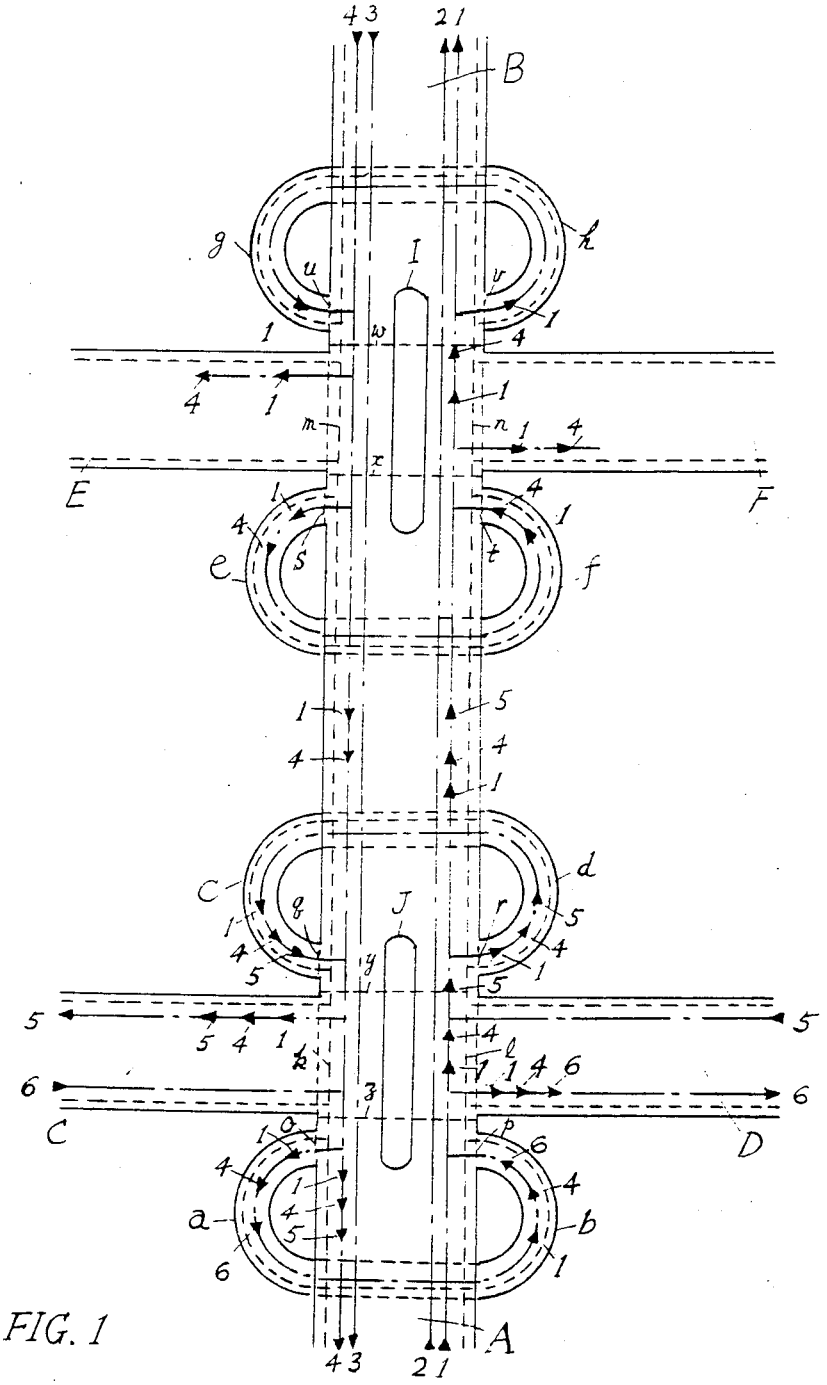
FIG. 1 is a plan view of the road construction of this invention and the traffic track of cars for right side driving.
Figure 2:
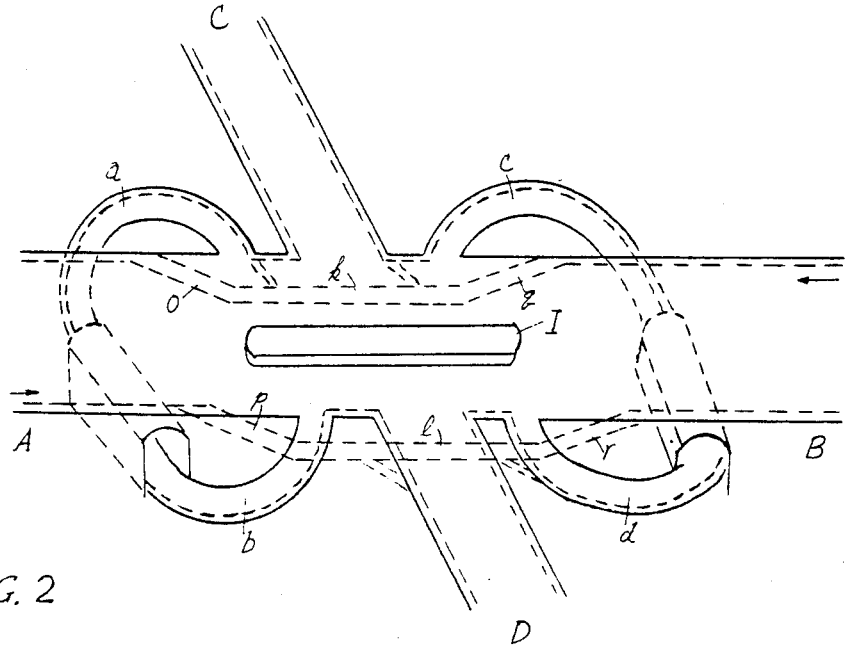
FIG. 2 is a perspective view of the connection of circular detour way and the main road by a tunnel./
Figure 3:
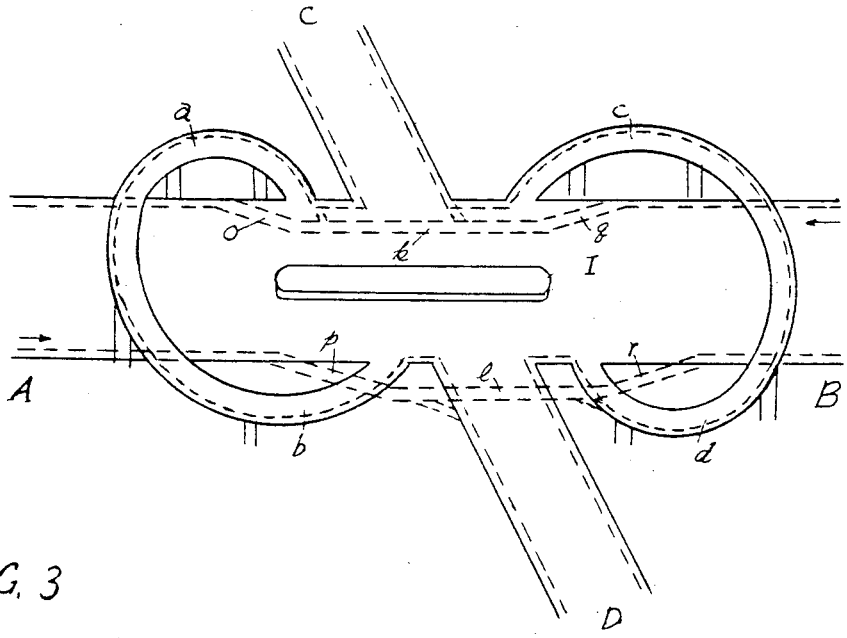
FIG. 3 is a perspective view of the connection of circular detour way and the main road by a bridge.
Figure 5:
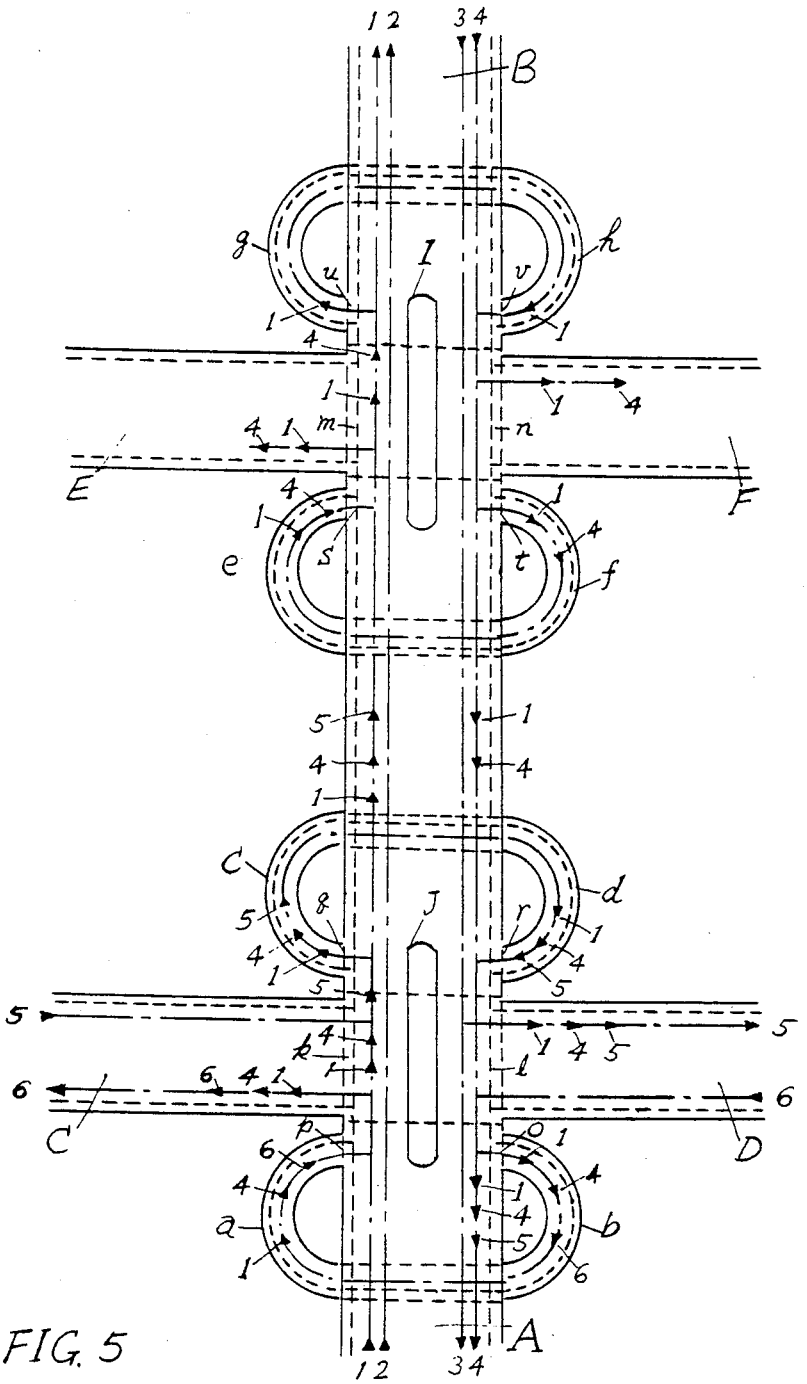
FIG. 5 is a plan view similar to FIG. 1 of the road construction and the traffic track of cars but for left side driving.

Referring to FIG. 1 for right side driving and FIG. 5 for left side driving, the south north road AB is a main road, and east west roads CD, EF are branch roads connected with the main road AB at right angles, and their intersections are flat. A safety island I or J is located at the intersection of the main road and branch road in such a manner that the longitudinal axis of said safety island is in parallel with the main road an equally divides the main road to block the cross traffic on the branch road. Circular detour ways ab, dc, ef, gh are provided on both sides of the main road, near the branch road. Two neighbor circular detour ways are at opposite sides of the main road which can be better seen in FIG. 2 and 3.

Where the bicycle and motorcycle are allowed to drive, a special path is drawn at the outermost side of each road as dashed lines shown in the drawings for them to use. To avoid conflict between the car and the motorcycle at the intersection, under ground passages for motorcycles or pedestrians are built under the intersections o,p,q,r,s,t,u,v of the circular detour ways, also shown as k,l,m,n under both sides of the main road in FIGS. 2 and 3. However under ground passages w,x,y,z may be built for pedestrian only. Thus no traffic signal is necessary except road signs and lane lines at the intersection of the roads. Therefore, all cars and motorcycles may go their own way without interruption or blockage. However, in heavy traffic areas, manual or automatic electronic controlled signal lights are used. Only one or two of such road constructions in a city will facilitate free and faster road communications with other cities.

Figure 4:
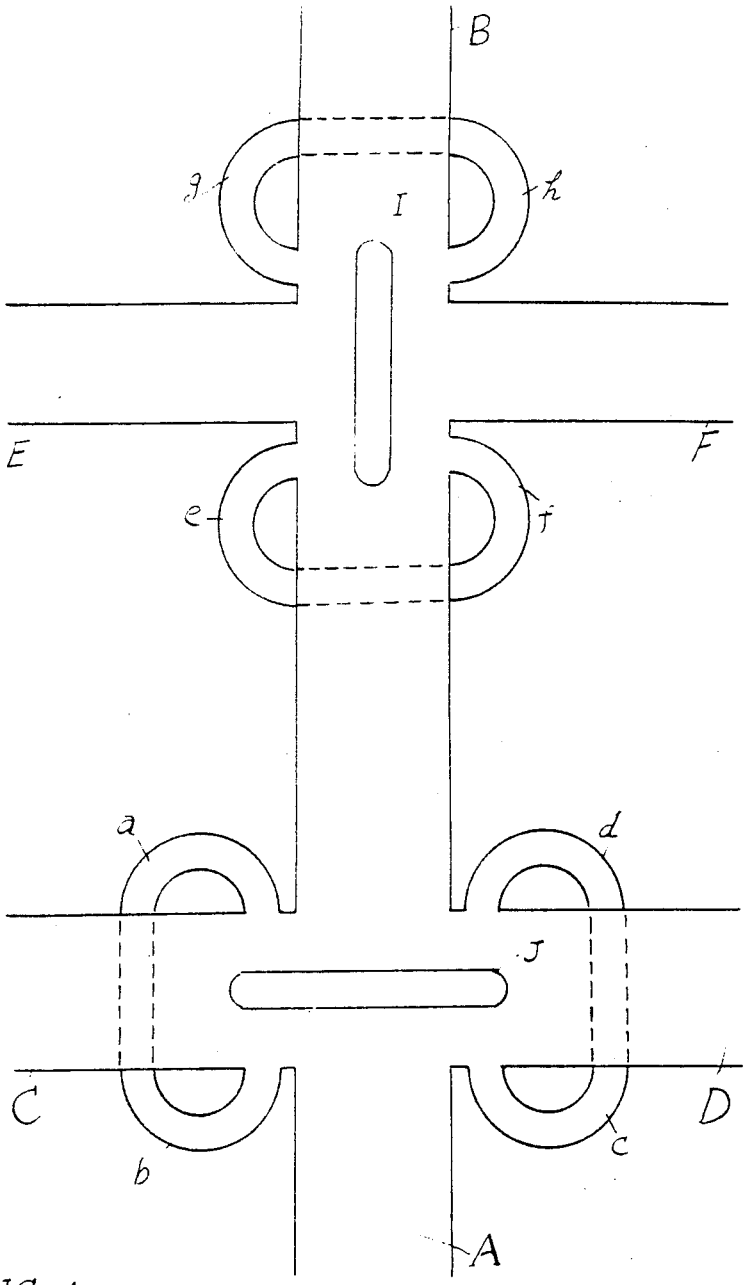
FIG. 4 is a plan view of the intersection of two main roads.

For an intersection of two main roads (FIG. 4) one of them must be designated a priority main road and the other a secondary main road.

The safety island than should be parallel with the priority main road.

METHOD OF TRAFFIC CONTROL

1. For right side driving.

Referring to FIG. 1, the main road AB runs south—north. It has four lanes of traffic and 1,2,3,4 arrows represent the direction of driving. The dotted and dashed lines and numerals represent lanes for the cars. It is obvious that the car lanes 2,3 on the inside can go straight through the intersection without obstruction, but cars on these lanes can not make right turns to branch road CD or EF unless they change lanes to outer lane. They also cannot make left or U-turns unless they go around the circular detour way cd or gh and through the tunnel or over head bridge. The cars on lanes 3 and 4 must go around the circular detour way ef or ab for left or U-turns.

Referring again to FIG. 1 the branch road CD runs east—west. It has two traffic lanes 5,6. The car on the 5 lane can make a right turn to the main road AB, but it can not make a left turn or proceed straight across the intersection because of the safety island j. IT must take circular detour way cd through the tunnel or over head bridge then make a right turn to road CD or proceed on the main road AB. The car on lane 6 similarly must take the circular detour way ab for left or U-turns.

2. For left side driving:

Referring to FIG. 5, the description is the same as in paragraph 1 above except all the rights or lefts are changed to lefts or rights, respectively.

3. With reference to a heavy traffic area, green and red signal lights may be installed in the intersection of the main road, and red and red with green right turn arrow signal lights may be installed on the intersection of the branch road. The cars on inner lane of the main road can go straight through at all times, and the cars on outer lane of the main road can go under control without difficulty to merge with the right turn of the cars from the branch road.

I claim:

1. A road intersection comprising:

a main road having at least two traffic lanes in each direction and an inside and an outside lane in each direction having parallel center lines;

a secondary road having at least one traffic lane in each direction intersecting said main road;

a traffic is land in said intersection extending parallel to and disposed between the inside lanes of said main road blocking the lanes of said secondary road;

a pair of opposed circular detour roads disposed on either side of said intersection each detour road having an entrance opening off of the outside lane of said main road and an exit onto the outside lane thereof proceeding in the opposite direction with each outside lane having an entrance on one side of the intersection and an exit on the other.

2. The intersection of claim 1 wherein the detour roads cross the main road on bridges thereover.

3. The intersection of claim 1 wherein the detour roads cross the main road in tunnels thereunder.

4. The intersection of claim 1 further comprising a pair of tunnels each having an entrance from an outer lane of said main road upstream of said intersection and an exit onto the outer lane downstream of said intersection for pedestrians or motorcycles.

* * * * *